US012085090B2

(12) United States Patent
Jia et al.

(10) Patent No.: US 12,085,090 B2
(45) Date of Patent: Sep. 10, 2024

(54) AIR BLOWER AND EXHAUST FAN COMPRISING THE SAME

(71) Applicant: Zhongshan Broad-Ocean Motor Co., Ltd., Zhongshan (CN)

(72) Inventors: Hongyu Jia, Zhongshan (CN); Huijun Zhan, Zhongshan (CN); Shaner Zhang, Zhongshan (CN); Xuanfeng Wen, Zhongshan (CN); Wei Lei, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 211 days.

(21) Appl. No.: 17/518,563

(22) Filed: Nov. 3, 2021

(65) Prior Publication Data

US 2022/0213901 A1 Jul. 7, 2022

Related U.S. Application Data

(63) Continuation-in-part of application No. PCT/CN2020/135066, filed on Dec. 10, 2020.

(30) Foreign Application Priority Data

Dec. 4, 2020 (CN) ..... 202022882825.4

(51) Int. Cl.
*F04D 29/00* (2006.01)
*F04D 17/16* (2006.01)
(Continued)

(52) U.S. Cl.
CPC ..... *F04D 29/4226* (2013.01); *F04D 17/16* (2013.01); *F04D 25/06* (2013.01);
(Continued)

(58) Field of Classification Search
CPC ..... F04D 29/4226; F04D 17/16; F04D 25/06; F04D 29/283; F04D 29/30; F04D 29/624; F04D 25/08; F04D 29/282
See application file for complete search history.

(56) References Cited

U.S. PATENT DOCUMENTS 3,602,006 A * 8/1971 Metcalfe ..... F24F 1/02 62/262
6,979,169 B2 * 12/2005 Penlesky ..... F04D 29/626 415/214.1
(Continued)

FOREIGN PATENT DOCUMENTS

CN 2228997 Y * 6/1996
CN 102182707 A 9/2011
(Continued)

*Primary Examiner* — Matthew T Largi
(74) *Attorney, Agent, or Firm* — MATTHIAS SCHOLL P.C.; Matthias Scholl

(57) ABSTRACT

An air blower, including a volute, a centrifugal wind wheel, and a motor. The volute includes an end plate, a side plate extending from an edge of the end plate, and a cavity formed by the end plate and the side plate; the centrifugal wind wheel is disposed in the cavity; the end plate includes an air inlet, and two ends of the side plate are disposed side by side to form an air outlet; the end plate further includes a support beam opposite to the air inlet, and the motor is disposed on the support beam.

5 Claims, 12 Drawing Sheets

(51) Int. Cl.

| | |
|---|---|
| ***F04D 25/06*** | (2006.01) |
| ***F04D 29/28*** | (2006.01) |
| ***F04D 29/30*** | (2006.01) |
| ***F04D 29/42*** | (2006.01) |
| ***F04D 29/62*** | (2006.01) |

(52) U.S. Cl.
CPC ..... *F04D 29/283* (2013.01); *F04D 29/30* (2013.01); *F04D 29/624* (2013.01)

(56) References Cited

U.S. PATENT DOCUMENTS

| | | | | |
|---|---|---|---|---|
| 9,097,265 | B1 * | 8/2015 | Tom | F24F 13/20 |
| 9,435,350 | B2 * | 9/2016 | Shirahama | F04D 29/4226 |
| 9,689,581 | B2 * | 6/2017 | Zakula | F24F 7/007 |
| 9,945,580 | B2 * | 4/2018 | Penlesky | F24F 13/32 |
| 2010/0014965 | A1 | 1/2010 | Watanabe et al. | |

FOREIGN PATENT DOCUMENTS

| | | | | |
|---|---|---|---|---|
| CN | 205001225 | U | | 1/2016 |
| CN | 107795508 | A | | 3/2018 |
| CN | 207813996 | U | | 9/2018 |
| CN | 111878424 | A | * | 11/2020 |
| WO | WO-2017020589 | A1 | * | 2/2017 |

* cited by examiner

AIR BLOWER AND EXHAUST FAN COMPRISING THE SAME

CROSS-REFERENCE TO RELATED APPLICATIONS

This application is a continuation-in-part of International Patent Application No. PCT/CN2020/135066 with an international filing date of Dec. 10, 2020, designating the United States, now pending, and further claims foreign priority benefits to Chinese Patent Application No. 202022882825.4 filed Dec. 4, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to an air blower and an exhaust fan comprising the same.

A conventional exhaust fan includes a box and an air blower disposed in the box. The box includes an air intake on the top and an air exit on the side. The air blower includes a volute, a wind wheel, and a motor. The wind wheel is disposed in the volute. The volute is made of iron sheet and includes an air inlet and an air outlet. The air outlet communicates with the air exit. The box further includes a mounting plate, and the motor is hoisted in the box through the mounting plate. The rotating shaft of the motor is connected to the wind wheel. The air enters the exhaust fan via the air intake, flows in and out of the volute via the air inlet and air outlet, respectively, and is discharged from the air exit. The motor is a shaded-pole motor which has high rotation speed, high energy efficiency and high noise. The motor is hoisted in the box through the mounting plate, which involves a complex installation process. The iron volute is easy to deform, so that the air output is unstable, and the assembly of the iron volute and the wind wheel is not accurate.

SUMMARY

The disclosure provides an air blower, comprising a volute, a centrifugal wind wheel, and a motor. The volute comprises an end plate, a side plate extending from an edge of the end plate, and a cavity formed by the end plate and the side plate; the centrifugal wind wheel is disposed in the cavity; the end plate comprises an air inlet, and two ends of the side plate are disposed side by side to form an air outlet; the end plate further comprises a support beam opposite to the air inlet, and the motor is disposed on the support beam.

In a class of this embodiment, a middle part of the support beam is sunken in a direction away from the air inlet of the volute to form a chamber, and the motor is accommodated in the chamber.

In a class of this embodiment, the middle part of the support beam comprises a through hole, and a rotating shaft of the motor passes through the through hole to connect to the centrifugal wind wheel.

In a class of this embodiment, the middle part of the support beam further comprises at least two first mounting holes disposed at two sides of the through hole; the motor comprises at least two second mounting holes matched with the at least two first mounting holes; and the motor is fixed on the support beam through a bolt-nut mechanism sequentially passing through the at least two first mounting holes and the at least two second mounting holes.

In a class of this embodiment, the end plate, the side plate, and the support beam are integrally formed.

In a class of this embodiment, the volute is a plastic shell formed by injection molding or a sheet metal shell formed by stamping; the motor comprises a starting capacitor, and the centrifugal wind wheel comprises plastic.

In a class of this embodiment, the centrifugal wind wheel comprises a wheel disc and a plurality of vanes circumferentially disposed on the wheel disc; the wheel disc comprises a central part, and a connection plate is disposed in the central part and is connected to the rotating shaft of the motor; an annular guide plate is disposed between the connection plate and the wheel disc; the plurality of vanes each comprises a pressure side comprising a first arc and a second arc; a radius R1 of the first arc is 4.53±0.5 mm; a radius R2 of the second arc is 10.43±0.5 mm; an inner diameter D1 of the plurality of vanes is 111.61±5 mm; an outer diameter D2 of the plurality of vanes is 131.17±5 mm; an included angle β1A between a tangent of a blade inlet profile and a circumferential direction is 83.93±5°, and an included angle β2A between a tangent of a blade outlet profile and a circumferential direction is 143.42±5°.

In a class of this embodiment, the volute comprises a volute tongue in the vicinity of the air outlet; the volute further comprises an air passage formed between the side plate of the volute and the centrifugal wind wheel; and a cross sectional area of the air passage increases along a direction from the volute tongue to the air outlet.

The disclosure also provides an exhaust fan, comprising a box and the aforesaid air blower; the box comprises a top plate, a side wall, and a bottom plate; the top plate, the side wall, and the bottom plate are connected to each other to form an accommodation cavity; the side wall comprises an air exit, and the top plate comprises an air intake; and the air blower is disposed in the accommodation cavity.

In a class of this embodiment, the volute is disposed on the bottom plate of the box; the end plate, the side plate of the volute, and the bottom plate of the box form a sealed cavity, and the centrifugal wind wheel is disposed in the sealed cavity.

In another aspect, the disclosure further provides an exhaust fan, comprising a box and an air blower. The box comprises a top plate, a side wall, and a bottom plate; the top plate, the side wall, and the bottom plate are connected to each other to form an accommodation cavity; the side wall comprises an air exit, and the top plate comprises an air intake.

The air blower comprises a volute, a centrifugal wind wheel, and a motor; the volute comprises an end plate, a side plate extending from an edge of the end plate, a cavity formed by the end plate and the side plate, and an opening opposite to the end plate; the centrifugal wind wheel is disposed in the cavity; the end plate comprises an air inlet, and two ends of the side plate are disposed side by side to form an air outlet; the volute is disposed in the accommodation cavity of the box and is attached to the bottom plate whereby the opening of the volute is sealed by the bottom plate; the air outlet communicates with the air exit; and the air intake, the air inlet, the air outlet and the air exit communicate with each other.

The end plate further comprises a support beam opposite to the air inlet, and the motor is disposed on the support beam; the volute is a plastic shell formed by injection molding or a sheet metal shell formed by stamping; and the motor comprises a starting capacitor.

The following advantages are associated with the air blower and the exhaust fan comprising the same of the disclosure:

The air blower comprises a volute, a centrifugal wind wheel, and a motor. The volute comprises an end plate, a side plate extending from an edge of the end plate, and a cavity formed by the end plate and the side plate; the centrifugal wind wheel is disposed in the cavity; the end plate comprises an air inlet, and two ends of the side plate are disposed side by side to form an air outlet; the end plate further comprises a support beam opposite to the air inlet, and the motor is disposed on the support beam. Thus, the volute and the motor are arranged reasonably and easy to assembly with each other, thus saving the installation parts and installation costs.

The exhaust fan comprises a box and an air blower; the box comprises a top plate, a side wall, and a bottom plate; the top plate, the side wall, and the bottom plate are connected to each other to form an accommodation cavity; the side wall comprises an air exit, and the top plate comprises an air intake. The air blower comprises a volute, a centrifugal wind wheel, and a motor; the volute comprises an end plate, a side plate extending from an edge of the end plate, a cavity formed by the end plate and the side plate, and an opening opposite to the end plate; the centrifugal wind wheel is disposed in the cavity; the end plate comprises an air inlet, and two ends of the side plate are disposed side by side to form an air outlet; the volute is disposed in the accommodation cavity of the box and is attached to the bottom plate whereby the opening of the volute is sealed by the bottom plate; the air outlet communicates with the air exit; and the air intake, the air inlet, the air outlet and the air exit communicate with each other. The end plate further comprises a support beam opposite to the air inlet, and the motor is disposed on the support beam; the volute is a plastic shell formed by injection molding or a sheet metal shell formed by stamping; and the motor comprises a starting capacitor. The volute is a plastic shell or a sheet metal shell with high dimensional accuracy, which is conducive to improving the exhaust volume of the air exit. The motor started by capacitor has low speed, low energy efficiency and low noise.

DETAILED DESCRIPTION

To further illustrate, embodiments detailing an air blower and an exhaust fan comprising the same are described below. It should be noted that the following embodiments are intended to describe and not to limit the disclosure.

Example 1

Figure 1:
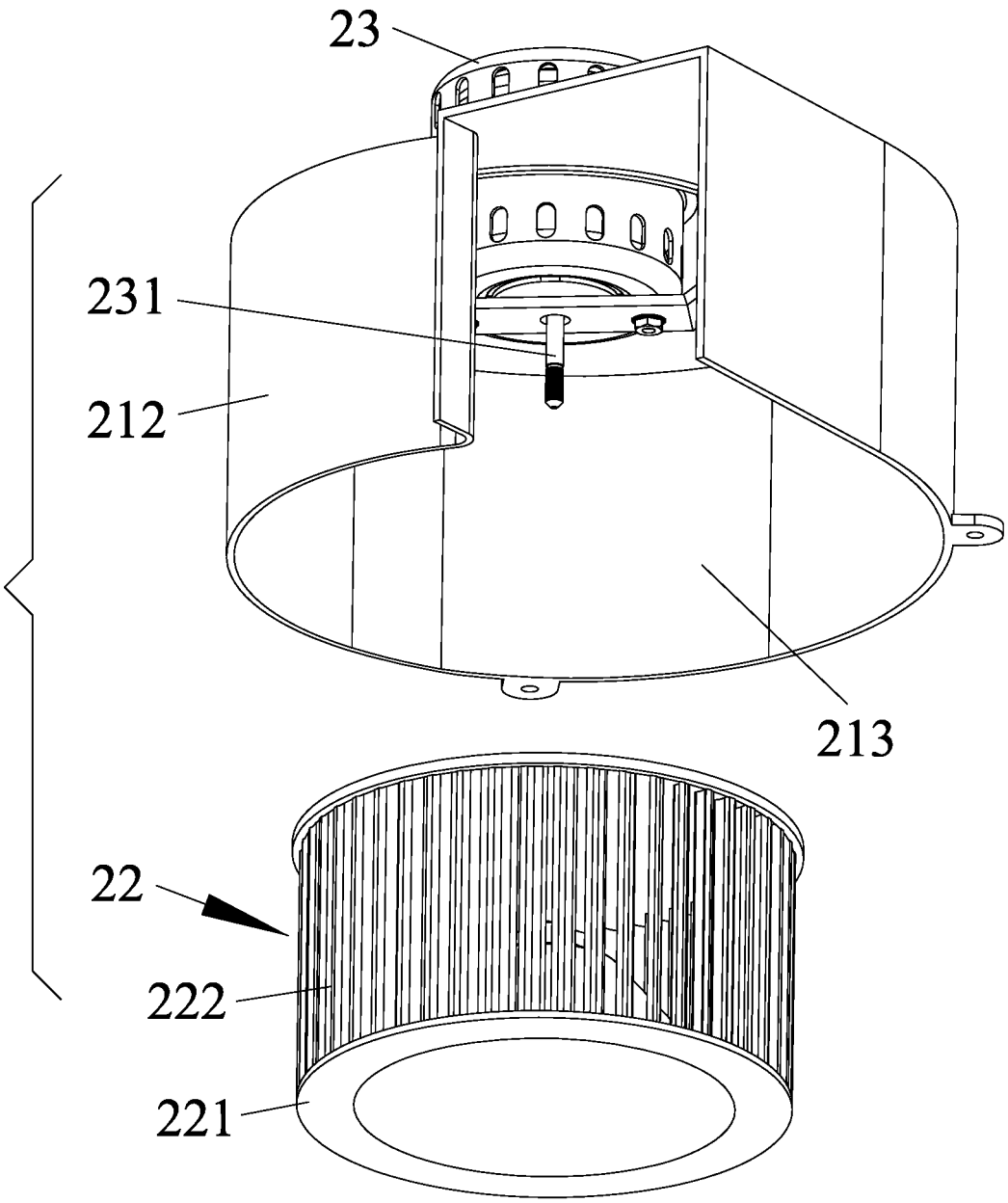
FIG. 1 is a schematic diagram of an air blower according to one embodiment of the disclosure.
Figure 2:
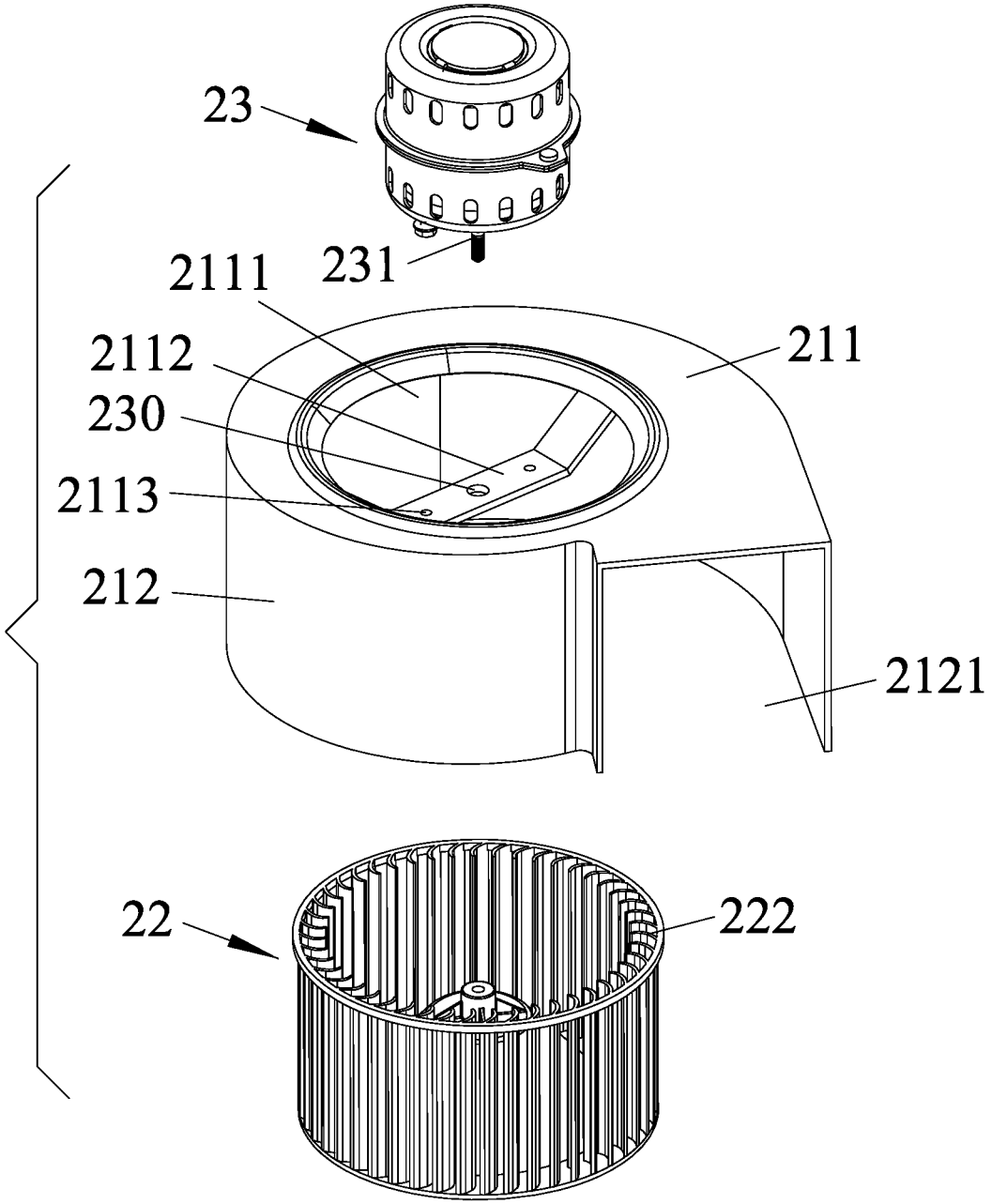
FIG. 2 is an exploded view of an air blower according to one embodiment of the disclosure.
Figure 3:
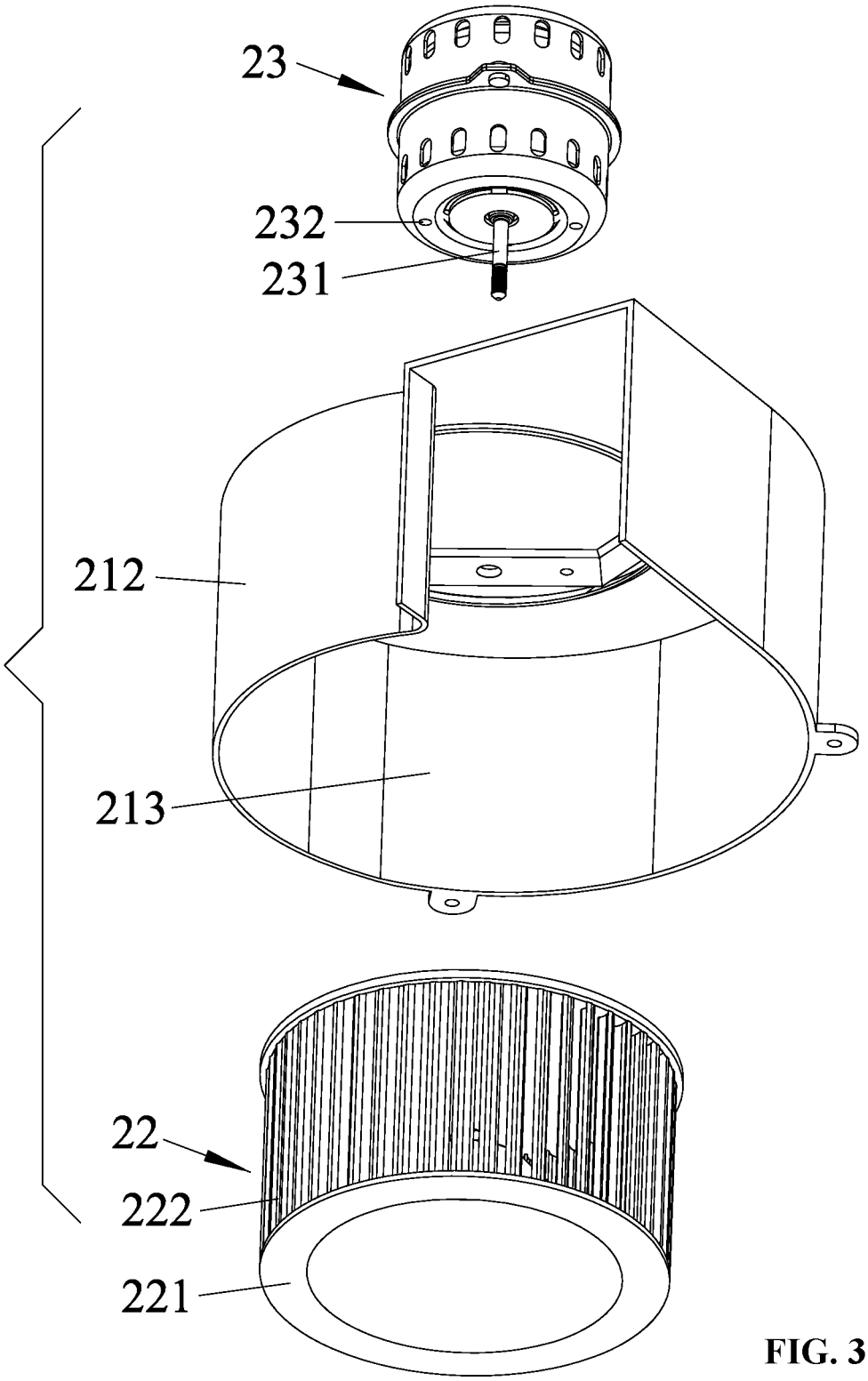
FIG. 3 is an exploded view of an air blower according to one embodiment of the disclosure in another angle of view.
Figure 4:
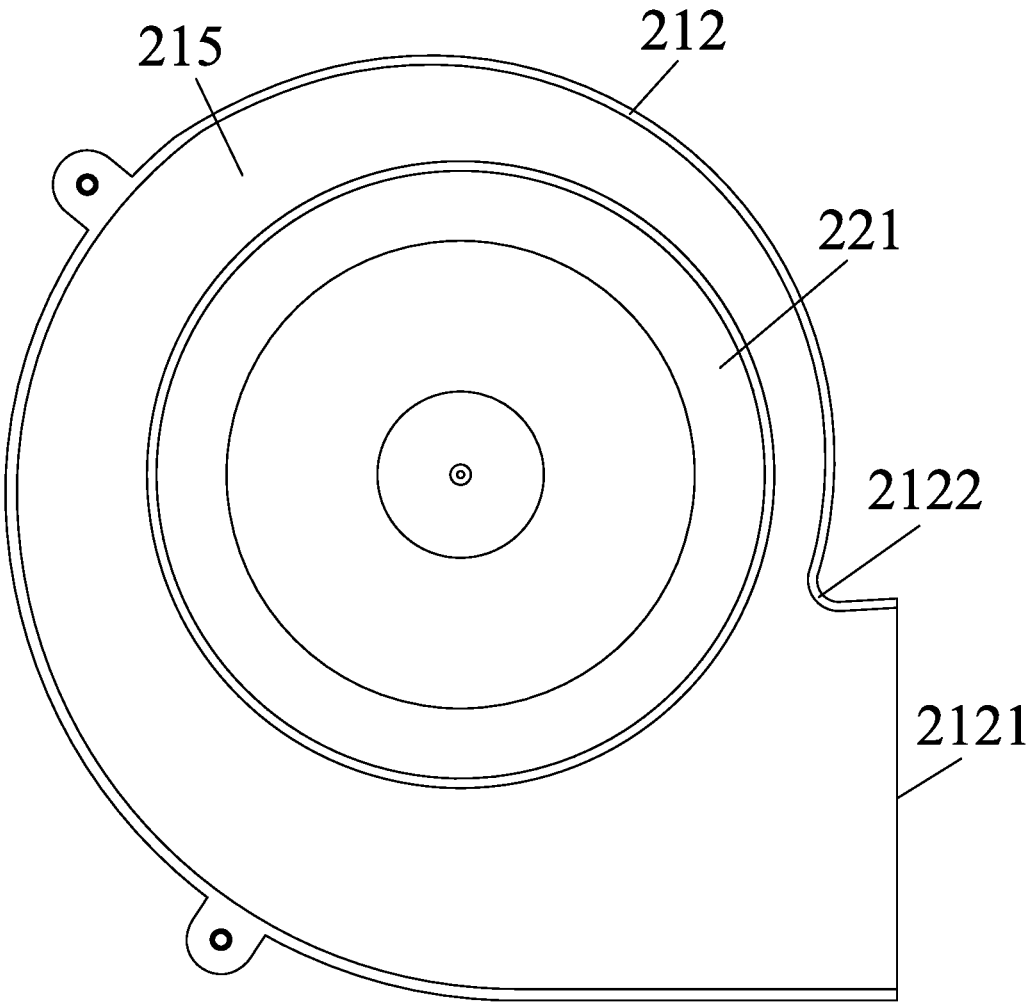
FIG. 4 is a front view of an air blower according to one embodiment of the disclosure.
Figure 5:
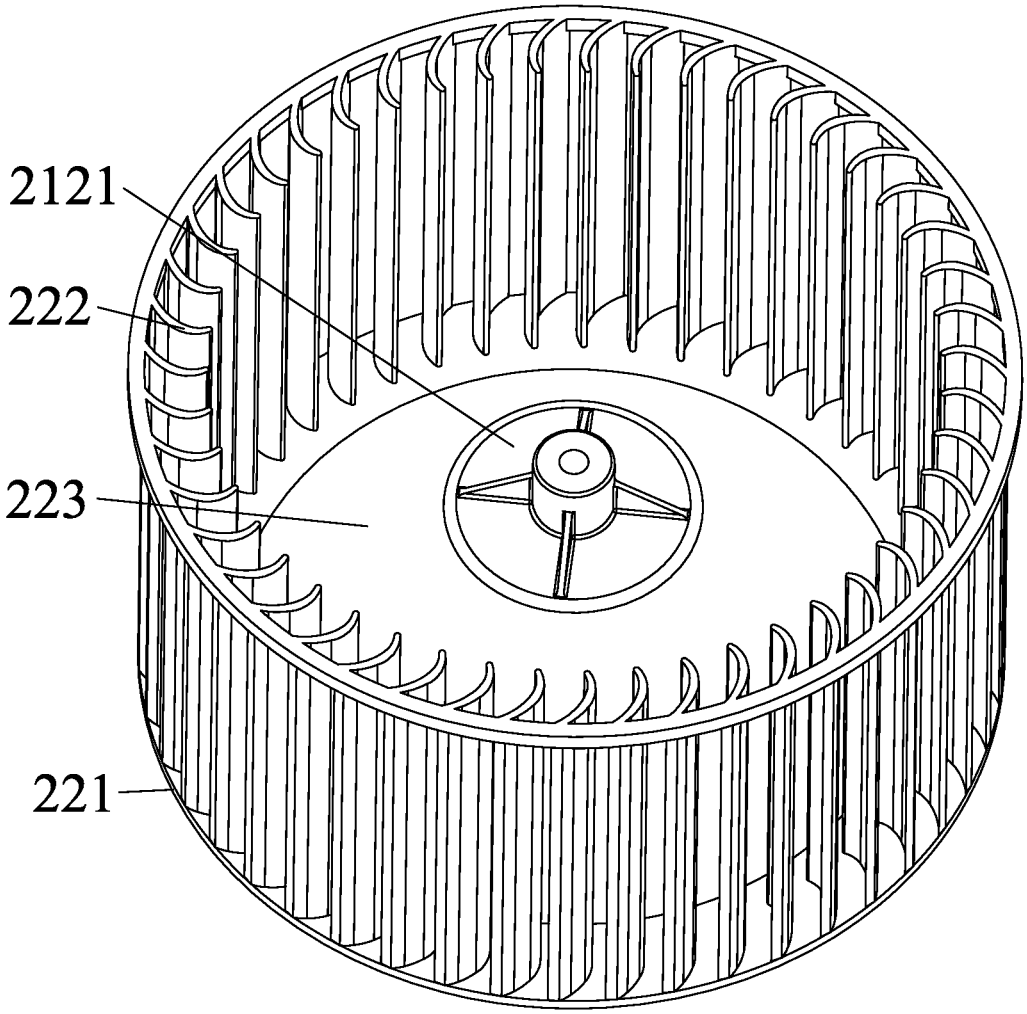
FIG. 5 is a schematic diagram of a centrifugal wind wheel according to one embodiment of the disclosure.
Figure 6:
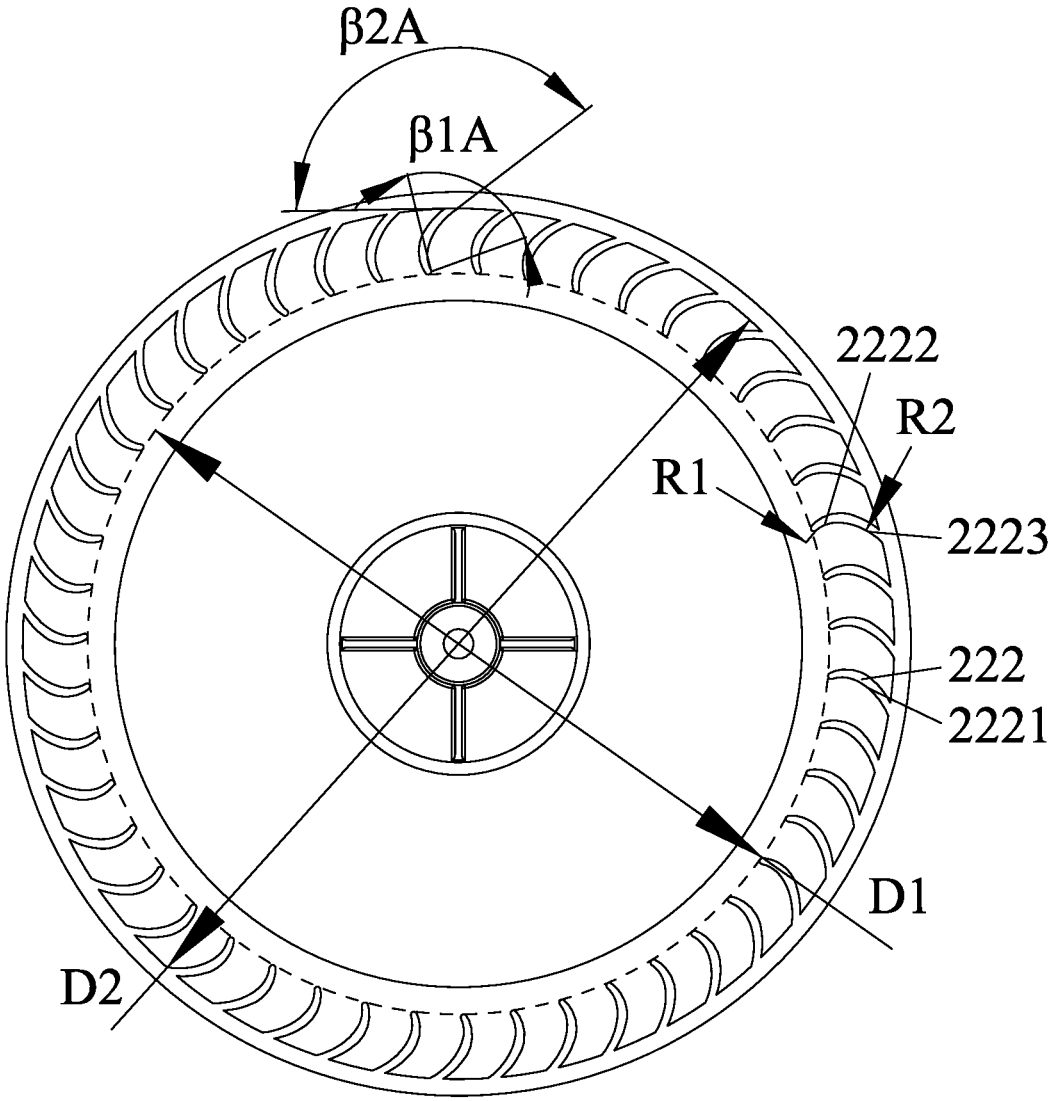
FIG. 6 is a front view of a centrifugal wind wheel according to one embodiment of the disclosure.
Figure 7:
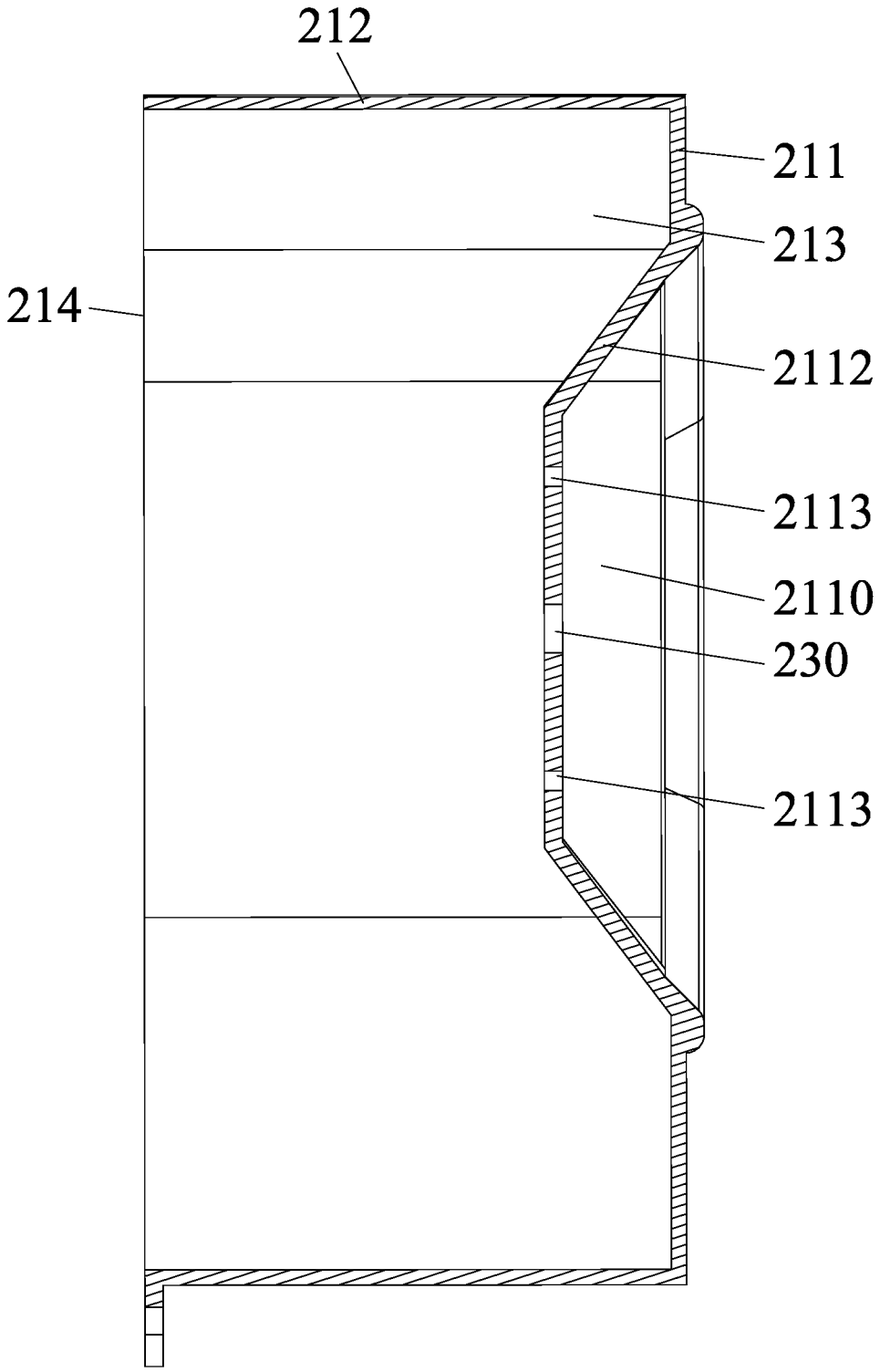
FIG. 7 is a sectional view of a volute according to one embodiment of the disclosure.

As shown in FIGS. 1-7, the disclosure provides an air blower comprising a volute 21, a centrifugal wind wheel 22, and a motor 23. The volute 21 comprises an end plate 211, a side plate 212 extending from an edge of the end plate 211, and a cavity 213 formed by the end plate 211 and the side plate 212; the centrifugal wind wheel 22 is disposed in the cavity 213; the end plate 211 comprises an air inlet 2111, and two ends of the side plate 212 are disposed side by side to form an air outlet 2121; the end plate 211 further comprises a support beam 2112 opposite to the air inlet 2111, and the motor 23 is disposed on the support beam 2112. With regard to the air blower, the volute and the motor are arranged reasonably and easy to assembly with each other, thus saving the installation parts and installation costs.

The middle part of the support beam 2112 is sunken in a direction away from the air inlet of the volute 21 to form a chamber 2110, and the motor is accommodated in the chamber 2110. In this way, the installation height of motor 23 is reduced, so is the installation height of a load driven by the motor, thus saving the manufacturing cost. In addition, the tilted parts on two sides of the middle part of the support beam 2112 play the role of the air diversion for the air inlet 2111.

The middle part of the support beam 2112 comprises a through hole 230, and the rotating shaft 231 of the motor 23 passes through the through hole 230 to connect to the centrifugal wind wheel 22, thus facilitating the connection of the motor and the centrifugal wind wheel.

The middle part of the support beam 2112 further comprises at least two first mounting holes 2113 disposed at two sides of the through hole 230; the motor 23 comprises at least two second mounting holes 232 matched with the at least two first mounting holes 2113; and the motor is fixed on the support beam 2112 through a bolt-nut mechanism sequentially passing through the at least two first mounting holes 2113 and the at least two second mounting holes 232. In this way, the motor is easily installed on the support beam.

The end plate 211, the side plate 212, and the support beam 2112 are integrally formed, so that the volute has high dimensional accuracy, is easy to manufacture, and the installation process is simple, saving the number of parts and the installation costs.

The volute 21 is a plastic shell formed by injection molding or a sheet metal shell formed by stamping. The motor 23 comprises a starting capacitor. The centrifugal wind wheel 22 comprises plastic, which is easy to manufacture, and with low cost, high dimensional accuracy, convenient installation and low noise. The volute 21 is a plastic shell or a sheet metal shell with high dimensional accuracy, which is conducive to improving the exhaust volume of the air exit. The motor started by capacitor has low speed, low energy efficiency and low noise.

The centrifugal wind wheel 22 comprises a wheel disc 221 and a plurality of vanes 222 circumferentially disposed on the wheel disc 221; the wheel disc 221 comprises a central part, and a connection plate 220 is disposed in the central part and is connected to the rotating shaft 231 of the motor 23; an annular guide plate 223 is disposed between the connection plate 220 and the wheel disc 221; the plurality of vanes 222 each comprises a pressure side 2221 comprising a first arc 2222 and a second arc 2223; a radius R1 of the first arc 2222 is 4.53±0.5 mm; a radius R2 of the second arc 2223 is 10.43±0.5 mm; an inner diameter D1 of the plurality of vanes 222 is 111.61±5 mm; an outer diameter D2 of the plurality of vanes 222 is 131.17±5 mm; the included angle β1A between a tangent of a blade inlet profile and a circumferential direction is 83.93±5°, and an included angle β2A between a tangent of a blade outlet profile and a circumferential direction is 143.42±5°. In this way, the vanes can cooperate with the volute 21 precisely, thus improving the air flow between vanes, which is helpful to improve the exhaust volume of the air exit.

The volute 21 comprises a volute tongue 2122 in the vicinity of the air outlet 2121; the volute 21 further comprises an air passage 215 formed between the side plate 212 of the volute 20 and the centrifugal wind wheel 22; and a cross sectional area of the air passage 215 increases along a direction from the volute tongue 2122 to the air outlet 2121, which is helpful to improve the exhaust volume of the air exit.

Example 2

Figure 8:
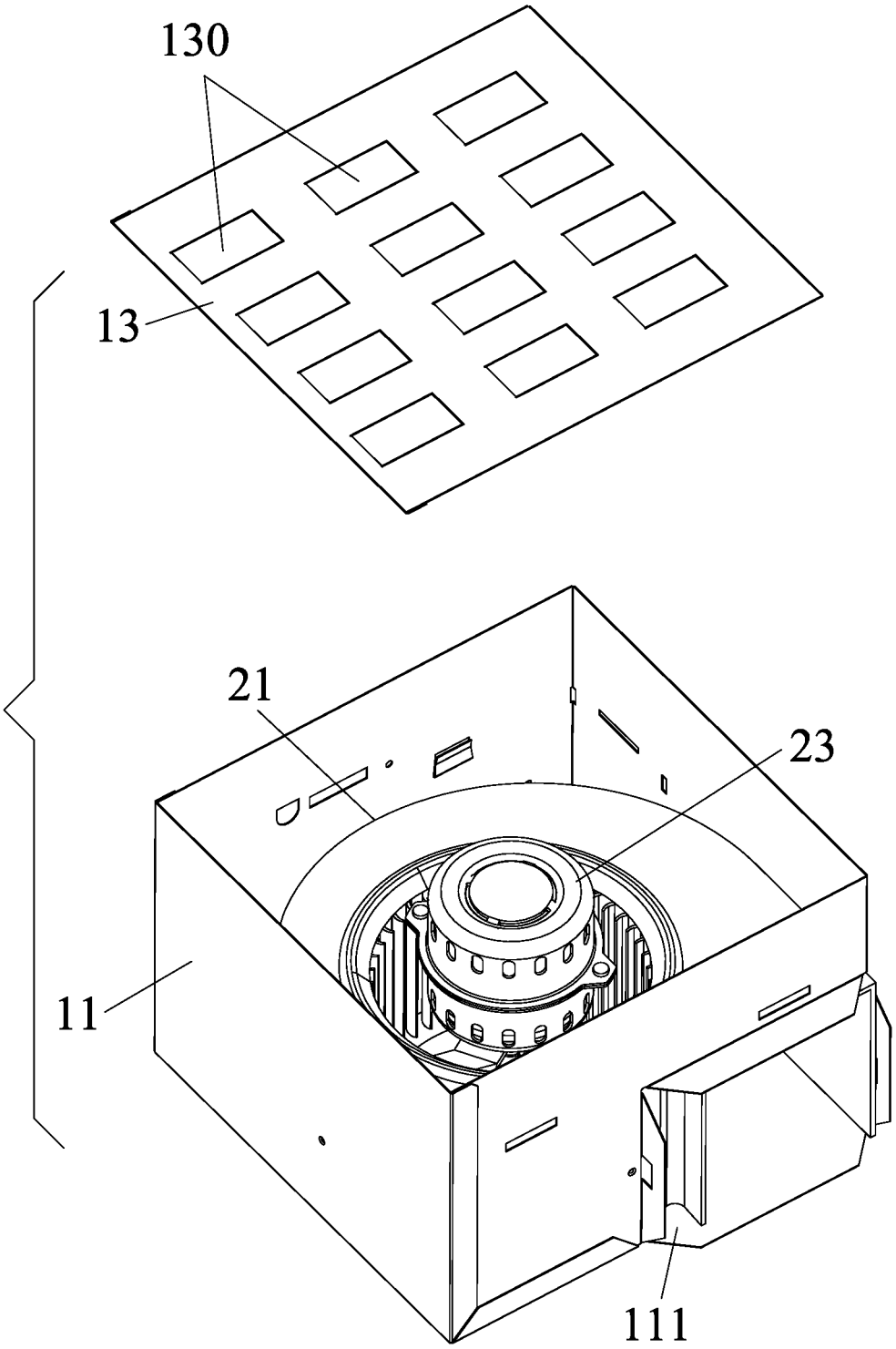
FIG. 8 is a schematic diagram of an exhaust fan according to one embodiment of the disclosure.
Figure 9:
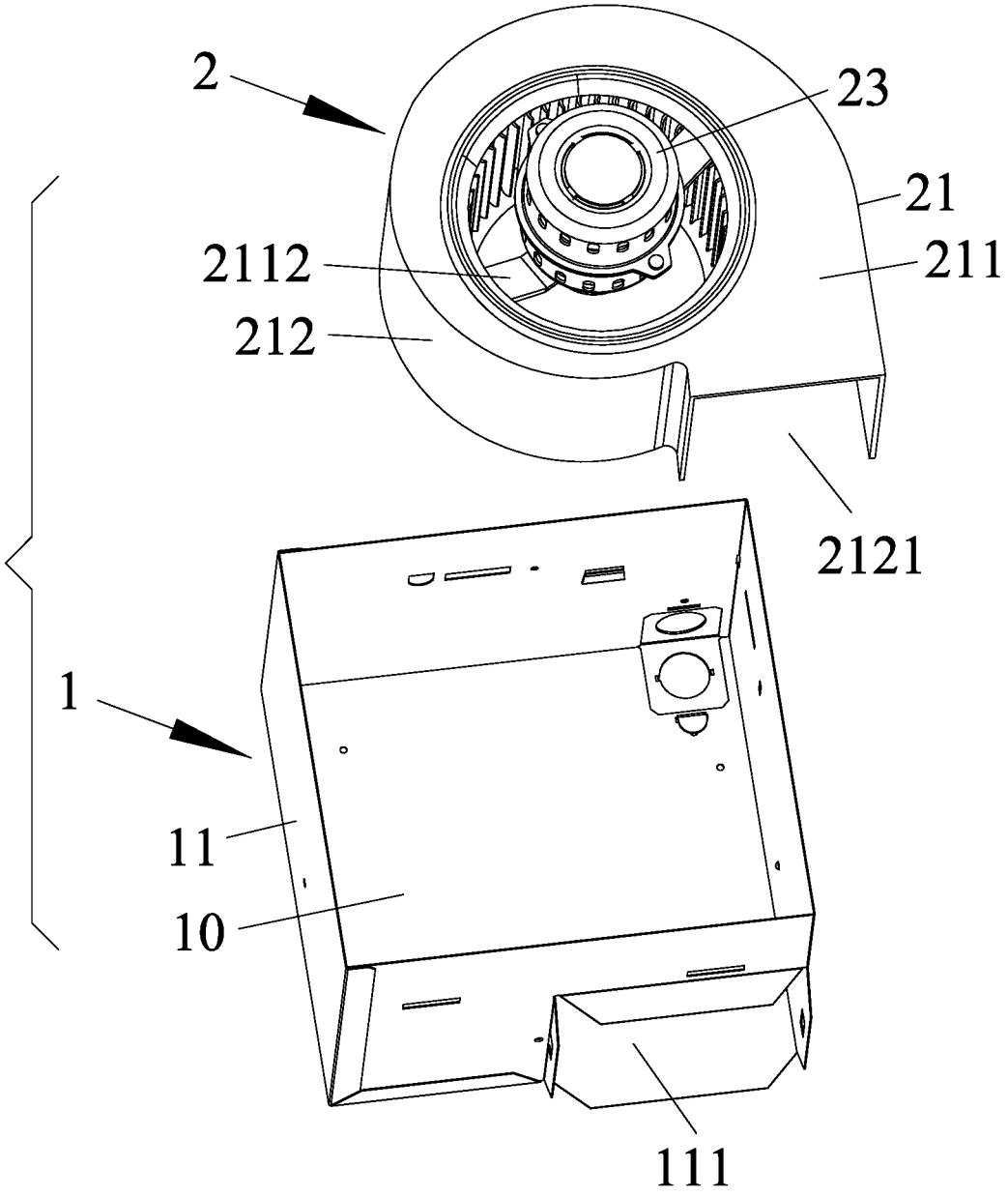
FIG. 9 is an exploded view of an exhaust fan according to one embodiment of the disclosure.
Figure 10:
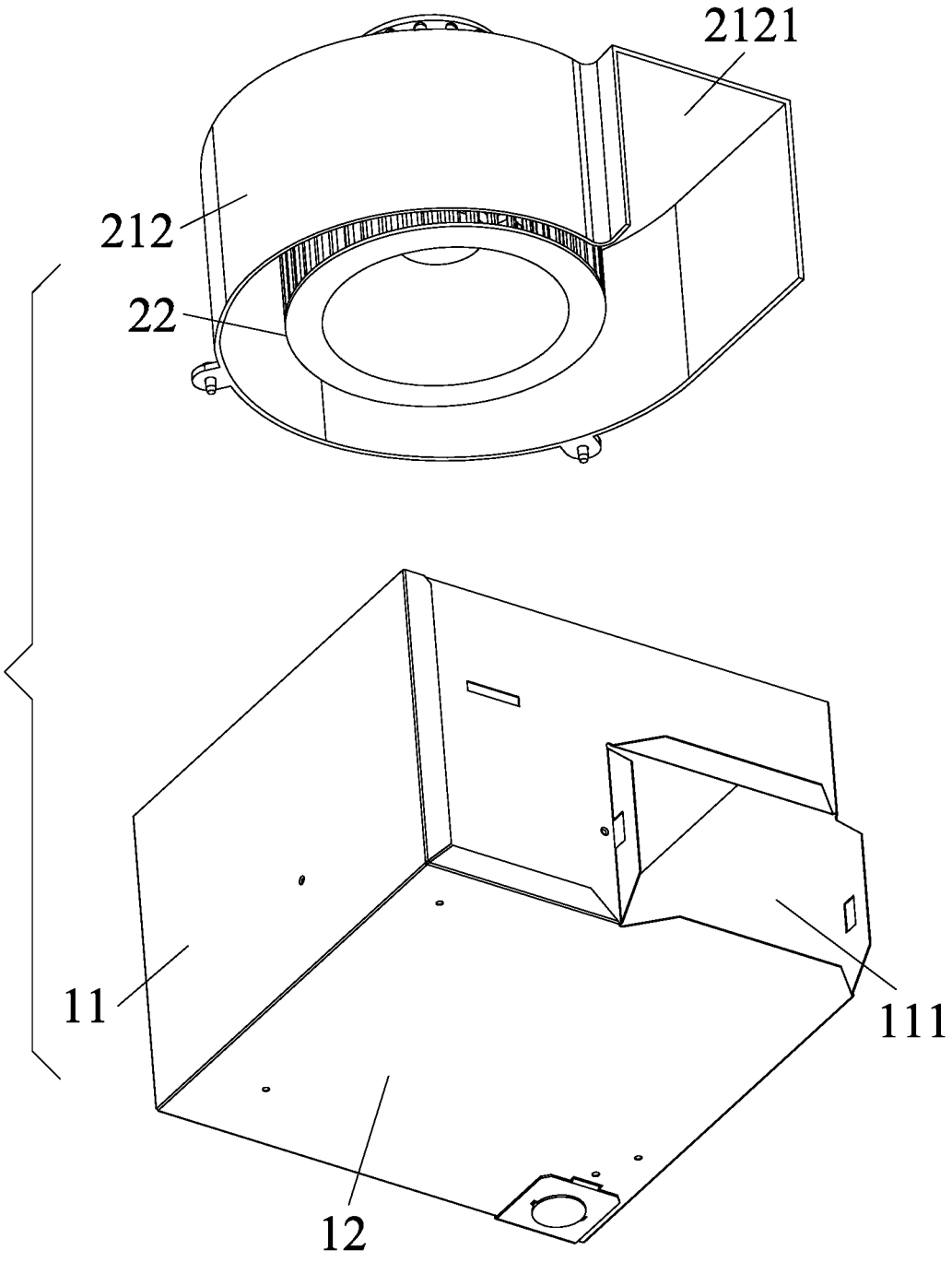
FIG. 10 is an exploded view of an exhaust fan according to one embodiment of the disclosure in another angle of view.
Figure 11:
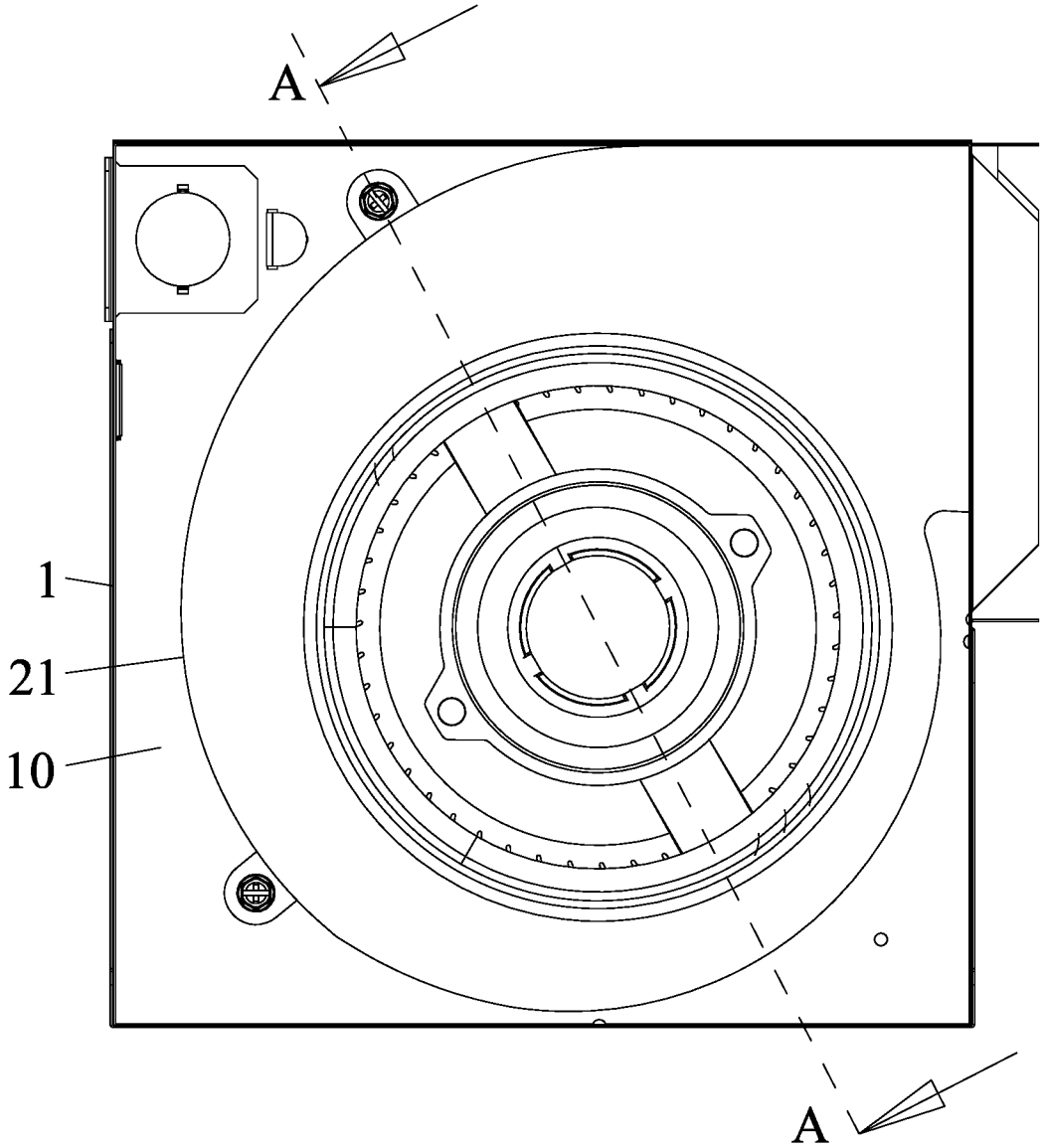
FIG. 11 is a schematic diagram of an exhaust fan according to another embodiment of the disclosure.
Figure 12:
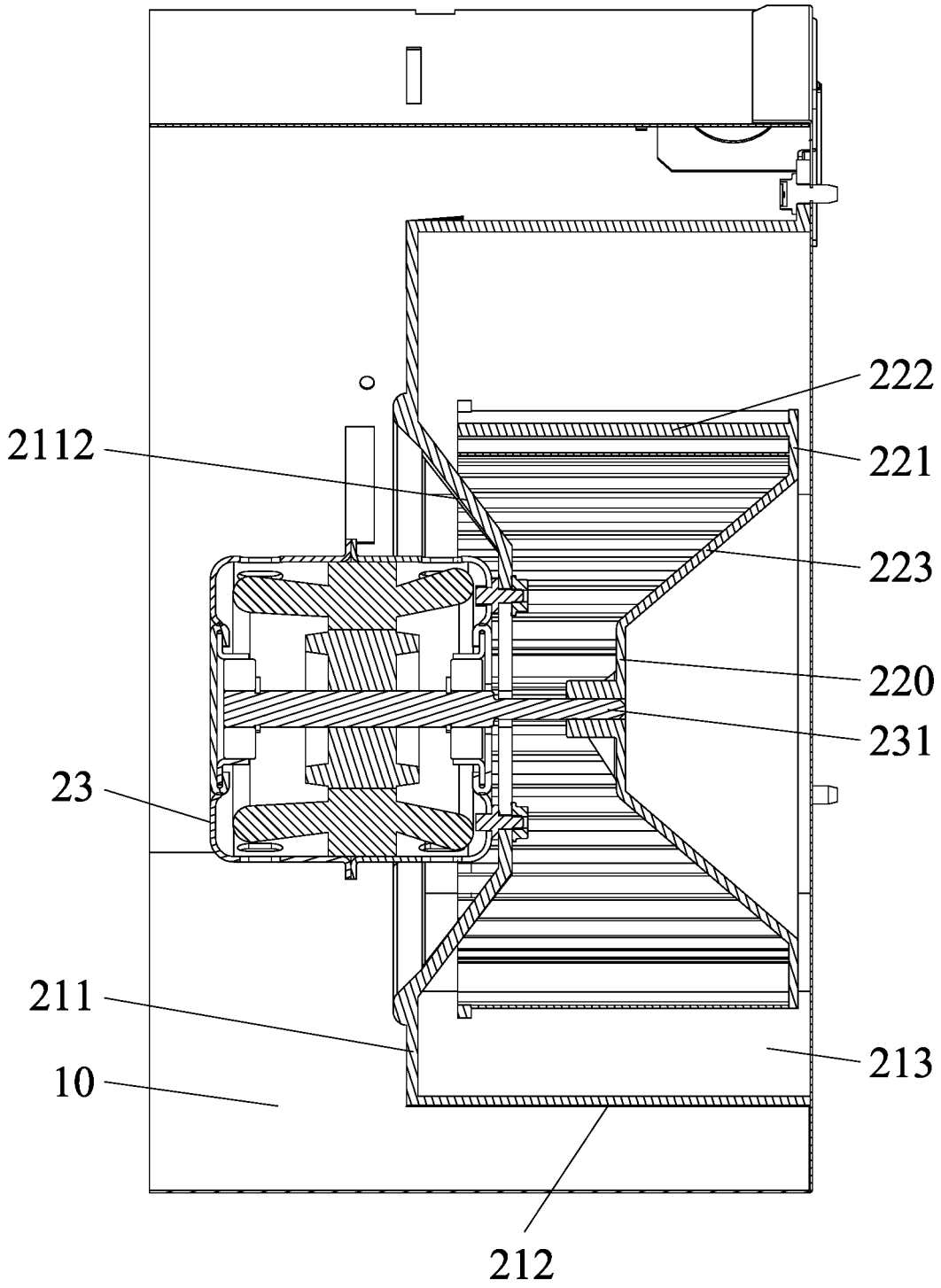
FIG. 12 is a sectional view taken from line A-A in FIG. 10.

As shown in FIGS. 8-12, the disclosure provides an exhaust fan, comprising a box 1 and an air blower 2 in Example 1; the box 1 comprises a top plate 13, a side wall 11, and a bottom plate 12; the top plate 13, the side wall 11, and the bottom plate 12 are connected to each other to form an accommodation cavity 10; the side wall comprises an air exit 111, and the top plate 13 comprises an air intake 130; and the air blower is disposed in the accommodation cavity 10. The volute 21 is disposed on the bottom plate 12 of the box 1; the end plate 211, the side plate 212 of the volute 21, and the bottom plate of the box 1 form a sealed cavity 213, and the centrifugal wind wheel 22 is disposed in the sealed cavity 213. The structure of the exhaust fan is reasonable, with low manufacturing cost.

Example 3

As shown in FIGS. 8-12, the disclosure provides an exhaust fan, comprising a box 1 and an air blower 2. The box 1 comprises a top plate 13, a side wall 11, and a bottom plate 12; the top plate 13, the side wall 11, and the bottom plate 12 are connected to each other to form an accommodation cavity 10; the side wall comprises an air exit 111, and the top plate 13 comprises an air intake 130.

The air blower 2 comprises a volute 21, a centrifugal wind wheel 22, and a motor 23; the volute 21 comprises an end plate 211, a side plate 212 extending from an edge of the end plate 211, a cavity 213 formed by the end plate 211 and the side plate 212, and an opening opposite to the end plate; the centrifugal wind wheel 22 is disposed in the cavity 213; the end plate 211 comprises an air inlet 2111, and two ends of the side plate 212 are disposed side by side to form an air outlet 2121; the volute 21 is disposed in the accommodation cavity 10 of the box 1 and is attached to the bottom plate 12 whereby the opening of the volute 21 is sealed by the bottom plate 12; the air outlet 2121 communicates with the air exit 111; and the air intake 130, the air inlet 2111, the air outlet 2121 and the air exit 111 communicate with each other.

The end plate 211 further comprises a support beam 2112 opposite to the air inlet 2111, and the motor 23 is disposed on the support beam 2112; the volute 21 is a plastic shell formed by injection molding or a sheet metal shell formed by stamping; and the motor 23 comprises a starting capacitor. The volute is a plastic shell or a sheet metal shell with high dimensional accuracy, which is conducive to improving the exhaust volume of the air exit. The motor started by capacitor has low speed, low energy efficiency and low noise.

It will be obvious to those skilled in the art that changes and modifications may be made, and therefore, the aim in the appended claims is to cover all such changes and modifications.

What is claimed is:

1. An air blower, comprising:

a volute, the volute comprising an end plate, a side plate extending from an edge of the end plate, and a cavity formed by the end plate and the side plate;

a centrifugal wind wheel; and a motor;

wherein:

the centrifugal wind wheel is disposed in the cavity;

the end plate comprises an air inlet, and two ends of the side plate are disposed side by side to form an air outlet;

the end plate further comprises a support beam opposite to the air inlet, and the motor is disposed on the support beam;

a middle part of the support beam is sunken in a direction away from the air inlet of the volute to form a chamber, and the motor is accommodated in the chamber;

the middle part of the support beam comprises a through hole, and a rotating shaft of the motor passes through the through hole to connect to the centrifugal wind wheel;

the middle part of the support beam further comprises at least two first mounting holes disposed at two sides of the through hole; the motor comprises at least two second mounting holes matched with the at least two first mounting holes; and the motor is fixed on the support beam through a bolt-nut mechanism sequentially passing through the at least two first mounting holes and the at least two second mounting holes;

the end plate, the side plate, and the support beam are integrally formed; and the centrifugal wind wheel comprises a wheel disc and a plurality of vanes circumferentially disposed on the wheel disc; the wheel disc comprises a central part, and a connection plate is disposed in the central part and is connected to the rotating shaft of the motor; an annular guide plate is disposed between the connection plate and the wheel disc; the plurality of vanes each comprises a pressure side comprising a first arc and a second arc; a radius R1 of the first arc is 4.53±0.5 mm; a radius R2 of the second arc is 10.43±0.5 mm; an inner diameter D1 of the plurality of vanes is 111.61±5 mm; an outer diameter D2 of the plurality of vanes is 131.17±5 mm; an included angle β1A between a tangent of a blade inlet profile and a circumferential direction is 83.93±5°, and an included angle β2A between a tangent of a blade outlet profile and a circumferential direction is 143.42±5°.

2. The air blower of claim 1, wherein the volute is a plastic shell formed by injection molding or is a sheet metal shell formed by stamping; the motor comprises a starting capacitor, and the centrifugal wind wheel comprises plastic.

3. The air blower of claim 1, wherein the volute comprises a volute tongue in the vicinity of the air outlet; the volute further comprises an air passage formed between the side plate of the volute and the centrifugal wind wheel; and a cross sectional area of the air passage increases along a direction from the volute tongue to the air outlet.

4. An exhaust fan, comprising a box and an air blower of claim 1; wherein the box comprises a top plate, a side wall, and a bottom plate; the top plate, the side wall, and the bottom plate are connected to each other to form an accommodation cavity; the side wall comprises an air exit, and the top plate comprises an air intake; and the air blower is disposed in the accommodation cavity.

5. The exhaust fan of claim 4, wherein the volute is disposed on the bottom plate of the box; the end plate, the side plate of the volute, and the bottom plate of the box form a sealed cavity, and the centrifugal wind wheel is disposed in the sealed cavity.

* * * * *